United States Patent [19]

Koroyasu

[11] Patent Number: 4,627,653

[45] Date of Patent: Dec. 9, 1986

[54] CARPET STRETCHER

[75] Inventor: Arata Koroyasu, Tatsuno, Japan

[73] Assignee: Kyokuto Sanki Kabushiki Kaisha, Tatsuno, Japan

[21] Appl. No.: 769,830

[22] Filed: Aug. 27, 1985

[30] Foreign Application Priority Data

Aug. 27, 1984 [JP] Japan ..... 59-129641[U]

[51] Int. Cl.[4] ..... A47G 27/04; B26F 1/32; F04F 21/20

[52] U.S. Cl. ..... 294/8.6; 254/200

[58] Field of Search ..... 294/8.6; 254/200, 201, 254/209, 212; 267/64.16, 64.28

[56] References Cited

U.S. PATENT DOCUMENTS 1,319,783 10/1919 Merrill ..... 267/64.28

2,882,642 4/1959 Hill ..... 294/8.6

3,572,800 3/1971 Graziano ..... 254/200

*Primary Examiner*—James B. Marbert

*Attorney, Agent, or Firm*—Millen & White

[57] ABSTRACT

A carpet stretcher comprises an engaging head having a number of forwardly downwardly extending prongs set in the lower surface thereof, a knee pad disposed in the rear, and an air cylinder which is substantially hermetically constructed and which has an air inlet valve at one end and a piston rod projecting at the other end. The engaging head and the knee pad are interconnected by the air cylinder. In stretching a carpet, the knee pad is kicked by the operator with his knee. The air cylinder serves to absorb shock and to transmit the knee-produced forces from the knee pad to the engaging head.

2 Claims, 2 Drawing Figures

CARPET STRETCHER

BACKGROUND OF THE INVENTION

1. Field of the Invention

The present invention relates to a carpet stretcher which, after a carpet has been spread on the floor of a room and fixed at one end thereof adjacent one wall of the room, stretches it toward the opposite wall of the room by holding the opposite end of the carpet.

2. Description of the Prior Art

There has been known a carpet stretcher comprising an engaging head fixed to the front end of a bar-like handle and having a number of forwardly downwardly extending prongs fixed to the lower surface thereof, a knee pad secured to the rear end of said bar-like handle, the arrangement being such that in operation the operator, with his one knee and one hand placed on a carpet to be stretched, holds said bar-like handle with his other hand and engages the prongs on said engaging head with the piled surface of the carpet and kicks said knee pad with his other knee so as to stretch the carpet. (See U.S. Pat. Nos. 2,882,642 and 3,374,023.)

Since the conventional carpet stretcher, though capable of adjusting the length of its bar-like handle in some steps, has no shock absorbing function imparted to its bar-like handle, there has been problem that when the operator kicks with his knee, he feels pain in the knee. Further, since a shock is applied to the carpet, a strong force is applied thereto only in a portion thereof, damaging the carpet and making it impossible to stretch it throughout its length.

SUMMARY OF THE INVENTION

Accordingly, a primary object of the invention is to provide a carpet stretcher which applies less shock to the knee and has a superior carpet stretching function and whose bar-like handle can be adjusted according to the physique of the operator.

DESCRIPTION OF THE PREFERRED EMBODIMENT

Figure 1:
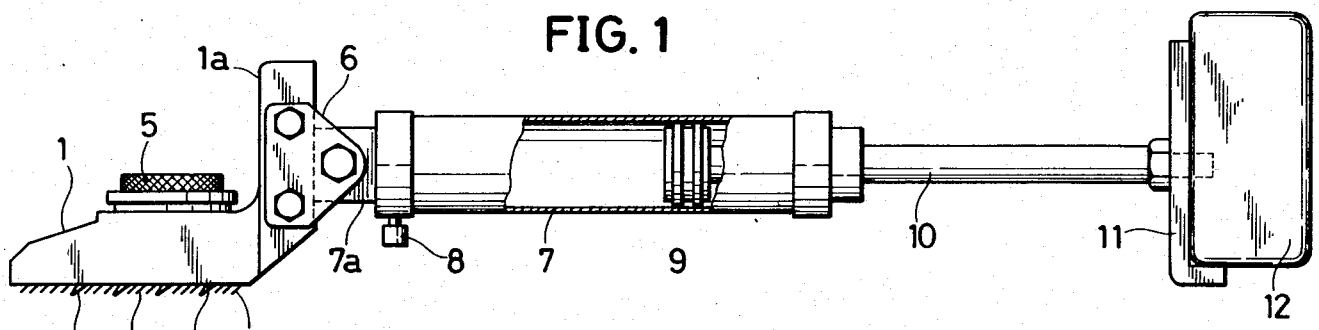
FIG. 1 is a side view of an embodiment of the invention.
Figure 2:
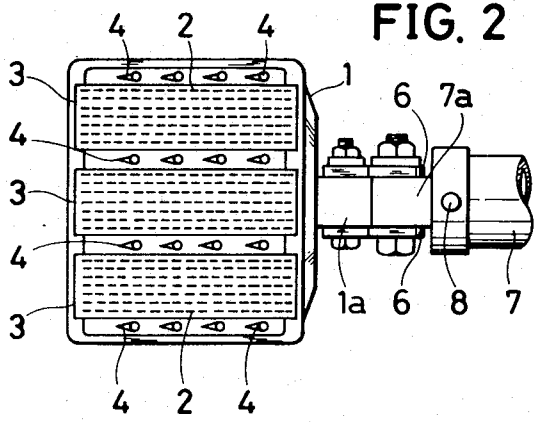
FIG. 2 is a bottom view of an engaging head shown in FIG. 1.

A carpet stretcher according to the present invention is characterized in that an engaging head 1 having a number of forwardly downwardly extending prongs 2 and 4 set in the lower surface thereof is connected to a knee pad 12 disposed in the rear by an air cylinder 7 having first and second ends which is substantially hermetically constructed and which has an air inlet valve 8 positioned adjacent to the first end and a piston rod 10 projecting from the second end. The piston rod 10 has a piston 9 fixed to a first end thereof while the second end thereof is fixed to the knee pad 12.

When air is injected into the air cylinder 7 from the air inlet valve 8 at one end, a piston 9 is slid by the injected air; the projecting length of the piston rod 10 increases with the increasing amount of air injected. Therefore, the overall length of the carpet stretcher is adjusted by increasing or decreasing the amount of air injected.

The operator, with his one knee and one hand placed on the carpet, holds the air cylinder 7 with his other hand, engages the prongs 2 and 4 on the engaging head 1 with the carpet, and kicks the knee pad 12 with his other knee, whereby the carpet is stretched in the same manner as in the prior art. However, the conventional bar-like handle is replaced by the air cylinder 7 and the latter is hermetically constructed. As a result, kicking with the knee causes the air in the air cylinder 7 to once elastically deform to absorb the shock, and then the subsequent restoring force of the air pushes out the engaging head forwardly so as to stretch the carpet.

The engaging head 1 has three thin-prong bases 3, each having a number of thin prongs 2 set in the lower surface thereof, as in the case of the prior art. A number of thick prongs 4 disposed between said thin-prong bases 3 are adapted to be raised and lowered by turning a knob 5 disposed above, whereby the downwardly extending length thereof can be adjusted. The rear end of the engaging head 1 is formed with a vertically extending ridge 1*a* for connection to the front projection 7*a* on the air cylinder 7 with a pair of connecting members 6 holding said ridge 1*a* therebetween. The air cylinder 7 has an air inlet valve 8 in the front lower surface. The piston rod 10 fixed to the piston 9 which slides in the air cylinder projects rearwardly, and the knee pad 12 is secured to the rear end of the piston rod 10 by a support member 11.

The carpet stretcher of the aforesaid embodiment was tested for performance in comparison with the conventional carpet stretcher having a bar-like handle, serving as a control example. More particularly, A 1200-mm long, 800-mm wide carpet was fixed at one end thereof on a floor by a gripper, while a 10-mm strain gauge was pasted to the carpet at a position 135 mm away from the fixed end thereof. The engaging head 1 was engaged with the carpet at a position 940 mm away from said strain gauge, and a fixed percussive load was applied thereto and the reaction from the knee pad 12 was measured. As a result, it was found that the elongation of the carpet in the embodiment of the invention is about twice as great as in the control example and that the peak value of the reaction from the knee pad 12 was 60 kg in contrast to 78.2 kg in the control example. Further, the elongation which was obtained by the operator actually kicking with his knee was greater in the present embodiment than in the control example. Furthermore, the operator remarked that when he used the carpet stretcher of the present embodiment, he felt less pain in his knee than when using the control example and that, therefore, he could have kicked even more strongly.

Concerning merits of the invention, since the conventional bar-like handle is replaced by an air cylinder, the shock produced upon kicking with the knee is reduced and so is the pain in the knee. Further, since energy is transmitted through the air cylinder, the transmission time is greatly increased as compared with the conventional value and the carpet can be stretched to a greater extent without damaging the carpet. Further, the provision of the air inlet valve makes it possible to adjust the overall length to the physique of the operator.

What is claimed is:

1. A carpet stretcher for stretching a fabric carpet, the carpet stretcher comprising:

an engaging head having an array of prongs thereon extending downwardly therefrom and at an oblique angle thereto to slant in a first direction for engaging the fabric of the carpet to push the carpet in the first direction;

an unvented fluid cylinder having first and second ends, wherein the first end of the cylinder is connected to the engaging head;

an inlet port adjacent to the first end of the cylinder for applying pressurized gas to the cylinder, the port including means for sealing the port to retain the gas in the cylinder;

a piston rod assembly having a piston disposed in the cylinder between the first and second ends wherein the first end is projected beyond the second end of the fluid cylinder, and a knee pad connected to the second end of the piston for abuttment with an operator's knee wherein the distance between the engaging head and knee pad is readily adjustable to suit operators of various sizes; wherein the gas within the cylinder is compressed upon impulsing the knee pad with one's knee while holding the cylinder in one's hand to absorb the shock of the impulse, and wherein expansion of the compressed gas after the impulse contributes to stretching the carpet.

2. The carpet stretcher of claim 1 wherein the array of prongs includes a subsarray of relatively thin prongs and a subarray of relatively thick prongs and wherein means are provided for moving the relatively thick prongs toward and away from the carpet with which the engaging head is engaged.

* * * * *